US011667995B2

(12) United States Patent
Godlewski et al.

(10) Patent No.: US 11,667,995 B2
(45) Date of Patent: Jun. 6, 2023

(54) CAST IRON ALLOY FOR AUTOMOTIVE ENGINE APPLICATIONS WITH SUPERIOR HIGH TEMPERATURE OXIDATION PROPERTIES

(71) Applicants: Ford Global Technologies, LLC, Dearborn, MI (US); The Curators of the University of Missouri, Columbia, MO (US)

(72) Inventors: Larry Alan Godlewski, Fenton, MI (US); Mei Li, Bloomfield Hills, MI (US); Carlos Engler-Pinto, Dearborn, MI (US); Simon Naymovich Lekakh, Columbia, MO (US)

(73) Assignees: Ford Global Technologies, LLC, Dearborn, MI (US); The Curators of the University of Missouri, Columbia, MO (US)

( * ) Notice: Subject to any disclaimer, the term of this patent is extended or adjusted under 35 U.S.C. 154(b) by 0 days.

(21) Appl. No.: 17/448,262

(22) Filed: Sep. 21, 2021

(65) Prior Publication Data

US 2023/0085990 A1 Mar. 23, 2023

(51) Int. Cl.
*C22C 37/10* (2006.01)
*C22C 37/04* (2006.01)

(52) U.S. Cl.
CPC ..... *C22C 37/10* (2013.01); *C22C 37/04* (2013.01)

(58) Field of Classification Search
CPC ..... C22C 37/10; C22C 37/04
See application file for complete search history.

(56) References Cited

U.S. PATENT DOCUMENTS

2010/0178193 A1* 7/2010 Zeipper ..... C22C 37/10 420/28
2013/0045127 A1* 2/2013 Sugiyama ..... C22C 33/08 164/47
2016/0053351 A1* 2/2016 Fujimoto ..... C22C 37/10 420/28

FOREIGN PATENT DOCUMENTS

| | | |
|---|---|---|
| EP | 0076701 | 4/1983 |
| EP | 1386976 | 2/2004 |
| EP | 1865082 | 12/2007 |
| EP | 2924138 | 9/2015 |
| KR | 20130130490 A * | 12/2013 |

OTHER PUBLICATIONS

KR20130130490A, Shin et al., machine translation (Year: 2013).*

* cited by examiner

*Primary Examiner* — John A Hevey
(74) *Attorney, Agent, or Firm* — Burris Law, PLLC

(57) ABSTRACT

A cast iron alloy is provided with a composition in weight percent (wt. %) of carbon between 2.6 to 3.4 wt. %, silicon between 2.4 to 3.2 wt. %, manganese between 0.3 to 0.6 wt. %, molybdenum between 0.4 to 1.2 wt. %, nickel between 0.6 to 1.75 wt. %, magnesium between 0.01 to 0.075 wt. %, aluminum between 1.8 to 3.5 wt. %, sulfur between 0.003 to 0.025 wt. %, zirconium between 0.001 to 0.02 wt. %, cerium between 0.001 to 0.03 wt. %, lanthanum between 0.0005 to 0.02 wt. %, and a balance of iron and unavoidable trace elements. A part formed from the cast iron alloy is also provided and the part has an Ac1 temperature equal to or greater than 895° C. and a thermo-mechanical fatigue lifetime of at least 10,000 cycles when cycled between 400° C. to 800° C. with a total cyclic strain equal to 0.001 m/m.

20 Claims, 7 Drawing Sheets

CAST IRON ALLOY FOR AUTOMOTIVE ENGINE APPLICATIONS WITH SUPERIOR HIGH TEMPERATURE OXIDATION PROPERTIES

STATEMENT REGARDING RIGHTS TO INVENTION MADE UNDER FEDERALLY-SPONSORED RESEARCH AND DEVELOPMENT

This invention was made with government support under Procurement Instrument Number DE-EE0008458 awarded by the U.S. Department of Energy. The government has certain rights in this invention.

FIELD

The present disclosure relates to cast iron alloys and particularly cast iron alloys for automotive applications.

BACKGROUND

The statements in this section merely provide background information related to the present disclosure and may not constitute prior art.

Cast iron alloys are used in a variety of industries due in part to relatively low cost, good casting properties, high machinability, good wear resistance, good vibration dampening properties, and reasonable corrosion resistance. However, in some applications known cast iron alloys suffer from high temperature corrosion and thermo-mechanical fatigue.

The present disclosure addresses issues related to high temperature corrosion resistance and/or thermo-mechanical fatigue of cast iron alloys, among other issues related to cast iron alloys.

SUMMARY

This section provides a general summary of the disclosure and is not a comprehensive disclosure of its full scope or all of its features.

In one form of the present disclosure, a cast iron alloy includes a composition in weight percent (wt. %) of carbon between 2.6 to 3.4 wt. %, silicon between 2.4 to 3.2 wt. %, manganese between 0.3 to 0.6 wt. %, molybdenum between 0.4 to 1.2 wt. %, nickel between 0.6 to 1.75 wt. %, magnesium between 0.01 to 0.075 wt. %, aluminum between 1.8 to 3.5 wt. %, sulfur between 0.003 to 0.025 wt. %, zirconium between 0.001 to 0.02 wt. %, cerium between 0.001 to 0.03 wt. %, lanthanum between 0.0005 to 0.02 wt. %, and a balance of iron and unavoidable trace elements.

In some variations, the carbon is between 2.8 to 3.2 wt. % and/or the silicon is between 2.6 to 3.2 wt. %.

In at least one variation, the manganese is between 0.32 to 0.5 wt. %.

In some variations, the molybdenum is between 0.6 to 1.0 wt. % and/or the nickel is between 0.8 to 1.5 wt. %.

In at least one variation, the magnesium is between 0.02 to 0.05 wt. %.

In some variations, the aluminum is between 2.0 to 3.2 wt. %.

In at least one variation, the sulfur is between 0.005 to 0.015 wt. % and/or the cerium is between 0.002 to 0.02 wt. %.

In some variations, the lanthanum is between 0.001 to 0.02 wt. %.

In at least one variation, the cast iron alloy further includes a plurality of graphite nodules formed on a lanthanum containing nuclei. And in such variations the lanthanum containing nuclei can be (La, Ce, Zr)(O, S) nuclei.

In some variations, a part is formed from the cast iron alloy and the part has an Ac1 temperature equal to or greater than 875° C. And in at least one variation, the Ac1 temperature is equal to or greater than 885° C.

In some variations, a part is formed from the cast iron alloy and the part has a thermo-mechanical fatigue lifetime of at least 10,000 cycles when cycled between 400° C. to 800° C. with a total cyclic strain equal to 0.001 m/m.

In at least one variation, a part is formed from the cast iron alloy and the part has a thermo-mechanical fatigue lifetime of at least 2,000 cycles when cycled between 400° C. to 800° C. with a total cyclic strain equal to 0.002 m/m.

And in some variations, the carbon is between 2.8 to 3.2 wt. %, the silicon is between 2.6 to 3.0 wt. %, the manganese is between 0.35 to 0.5 wt. %, the molybdenum is between 0.6 to 1.0 wt. %, the nickel is between 0.8 to 1.5 wt. %, the magnesium is between 0.02 to 0.05 wt. %, the aluminum is between 2.0 to 3.2 wt. %, the sulfur is between 0.005 to 0.015 wt. %, the zirconium is between 0.002 to 0.01 wt. %, the cerium is between 0.002 to 0.02 wt. %, and the lanthanum is between 0.001 to 0.01 wt. %.

In another form of the present disclosure, a cast iron alloy with a composition in weight percent (wt. %) includes carbon between 2.6 to 3.4 wt. %, silicon between 2.4 to 3.2 wt. %, manganese between 0.32 to 0.6 wt. %, molybdenum between 0.4 to 1.2 wt. %, nickel between 0.6 to 1.75 wt. %, magnesium between 0.01 to 0.075 wt. %, aluminum between 1.8 to 3.5 wt. %, sulfur between 0.003 to 0.025 wt. %, zirconium between 0.001 to 0.02 wt. %, cerium between 0.001 to 0.03 wt. %, lanthanum between 0.0005 to 0.02 wt. %, and a balance of iron and unavoidable trace elements.

In some variations, the carbon is between 2.8 to 3.2 wt. %, the silicon is between 2.6 to 3.0 wt. %, the manganese is between 0.35 to 0.5 wt. %, the molybdenum is between 0.6 to 1.0 wt. %, the nickel is between 0.8 to 1.5 wt. %, the magnesium is between 0.02 to 0.05 wt. %, the aluminum is between 2.0 to 3.2 wt. %, the sulfur is between 0.005 to 0.015 wt. %, the zirconium is between 0.002 to 0.01 wt. %, the cerium is between 0.002 to 0.02 wt. %, and the lanthanum is between 0.001 to 0.01 wt. %.

In at least one variation, a part is formed from the cast iron alloy and the part has an Ac1 temperature equal to or greater than 885° C., a thermo-mechanical fatigue lifetime of at least 10,000 cycles when cycled between 400° C. to 800° C. with a total cyclic strain equal to 0.001 m/m, and/or a thermo-mechanical fatigue lifetime of at least 2,000 cycles when cycled between 400° C. to 800° C. with a total cyclic strain equal to 0.002 m/m.

In still another form of the present disclosure, a cast iron alloy with a composition in weight percent (wt. %) includes carbon between 2.6 to 3.4 wt. %, silicon between 2.4 to 3.2 wt. %, manganese between 0.35 to 0.5 wt. %, molybdenum between 0.4 to 1.2 wt. %, nickel between 0.6 to 1.75 wt. %, magnesium between 0.01 to 0.075 wt. %, aluminum between 1.8 to 3.5 wt. %, sulfur between 0.003 to 0.025 wt. %, zirconium between 0.001 to 0.02 wt. %, cerium between 0.001 to 0.03 wt. %, lanthanum between 0.0005 to 0.02 wt. %, balance of iron and unavoidable trace elements, and a plurality of graphite nodules formed on (La, Ce, Zr)(O, S) nuclei.

In some variations, an exhaust manifold is formed from the cast iron alloy and the exhaust manifold has a thermo-mechanical fatigue lifetime of at least 10,000 cycles when cycled between 400° C. to 800° C. with a total cyclic strain equal to 0.001 m/m, and/or a thermo-mechanical fatigue lifetime of at least 2,000 cycles when cycled between 400° C. to 800° C. with a total cyclic strain equal to 0.002 m/m.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 6:
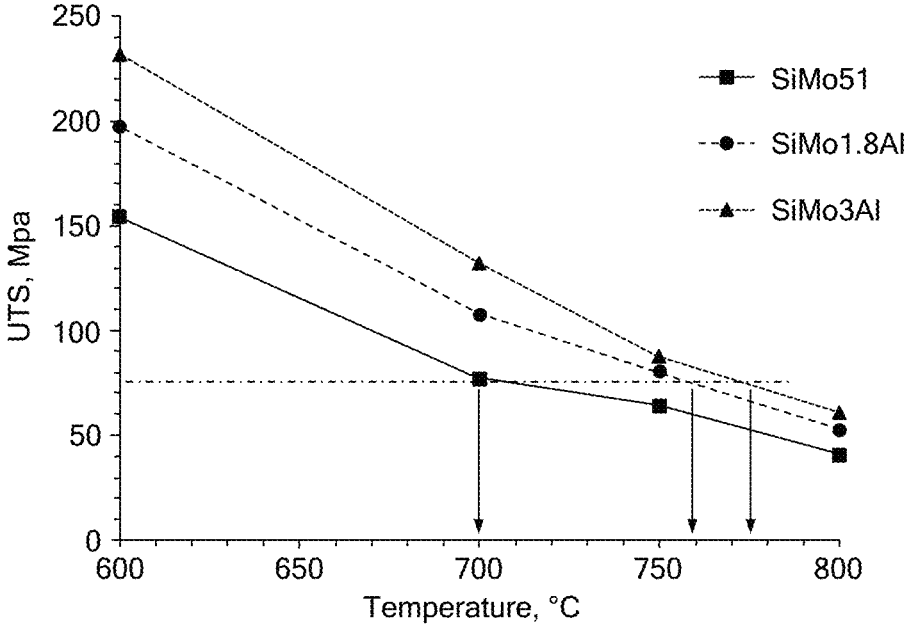
Figure 7:
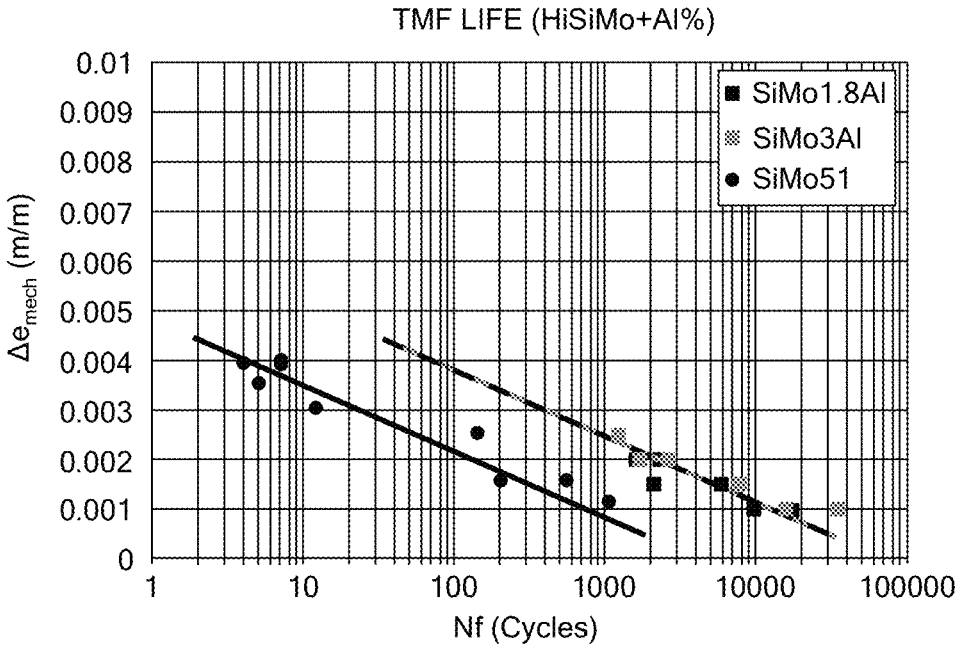

FIG. 6 is a plot of ultimate tensile strength as a function of temperature for the commercial SiMo51 cast iron alloy, the cast iron alloy with 1.8 wt. % aluminum, and the cast iron alloy with 3.0 wt. % aluminum; and FIG. 7 is a plot of change in strain as a function of number of cycles to failure at temperatures ranging from 400° C. to 800° C. for thermal mechanical fatigue testing of the commercial SiMo51 cast iron alloy, a cast iron alloy with 1.8 wt. % Al, and the cast iron alloy with 3.0 wt. % aluminum.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure provides one or more cast iron alloys (referred to herein simply as "cast iron alloy") with improved high temperature oxidation resistance and enhanced thermo-mechanical fatigue (TMF) resistance. As used herein the phrase "high temperature oxidation" refers to oxidation of the cast iron alloy in an oxygen containing atmosphere at elevated temperatures and the phrase TMF refers to a combination of cyclic mechanical loading resulting in fatigue of the cast iron alloy and cyclic thermal loading or exposure that results in high temperature oxidation of the cast iron alloy.

The cast iron alloy of the present disclosure includes carbon (C), silicon (Si), manganese (Mn), molybdenum (Mo), nickel (Ni), and aluminum (Al), with a balance of iron (Fe) and unavoidable trace elements. And in some variations the cast iron alloy includes magnesium (Mg), sulfur (S), zirconium (Zr), cerium (Ce), and lanthanum (La). Non-limiting examples of trace elements include boron (B), lead (Pb), bismuth (Bi), titanium (Ti), zinc (Zn), chromium (Cr), cobalt (Co), niobium (Nb), and copper (Cu), among others.

Regarding the alloying elements noted above, the amount of C affects the volume of a graphite phrase in and the solidification sequence of the cast iron alloy. In some variations, the solidification mode of the cast iron alloy is hypoeutectic. In addition, lower levels of C result in lower thermal conductivity of the cast iron alloy and high levels result in a hypereutectic mode of solidification. Accordingly, a lower limit of C in the cast iron alloy is about 2.6 weight percent (wt. %) and an upper limit of C on the cast iron alloy is about 3.4 wt. %. And in at least one variation, C in the cast iron alloy is between about 2.8 wt. % and about 3.2 wt. %.

The amount of Si affects the high temperature oxidation resistance, carbon activity, and ductility of the cast iron alloy. Particularly, high concentrations of Si generally improve the high temperature oxidation resistance but decrease the ductility of the cast iron alloy. Accordingly, a lower limit of Si in the cast iron alloy is about 2.4 wt. % and an upper limit of C on the cast iron alloy is about 3.2 wt. %. In at least one variation, Si in the cast iron alloy is between about 2.6 wt. % and about 3.2 wt. %. And in some variations, C in the cast iron alloy is between about 2.8 wt. % and about 3.2 wt. %, and Si in the cast iron alloy is between about 2.6 wt. % and about 3.2 wt. %.

The amount of Mn affects the hardenability, machinability, ductility and impact properties. Particularly, Mn reacts with S in the cast iron alloy such that formation of brittle iron sulfides is reduced and increases the mass or volume fraction of pearlite in the cast iron alloy. And as the amount of pearlite increases in the cast iron alloy, hardness, yield strength, and tensile strength increase while tensile elongation (ductility) decreases. In addition, when the Mn content exceeds an amount needed for a fully pearlitic microstructure, the cast iron alloy becomes embrittled with a decreasing in the tensile strength and continued reduction in the ductility. Accordingly, a lower limit of Mn in the cast iron alloy is about 0.3 wt. % and an upper limit of Mn in the cast iron alloy is about 0.6 wt. %. And in at least one variation, Mn in the cast iron alloy is between about 0.32 wt. % and about 0.5 wt. %.

The amount of Mo affects high temperature mechanical properties including creep and hardenability of the cast iron alloy. Particularly, Mo additions increase strength, hardenability and cost, but can reduce ductility of the cast iron alloy. Accordingly, a lower limit of Mo in the cast iron alloy is about 0.4 wt. % and an upper limit of Mo in the cast iron alloy is about 1.2 wt. %. And in at least one variation, Mo in the cast iron alloy is between about 0.6 wt. % and about 1.0 wt. %.

The amount of Ni affects strength, machinability, and toughness of the cast iron alloy. Particularly, Ni additions increase strength, machinability, toughness, and cost. Accordingly, a lower limit of Ni in the cast iron alloy is about 0.6 wt. % and an upper limit of Ni in the cast iron alloy is about 1.75 wt. %. In at least one variation, Ni content in the cast iron alloy is between about 0.8 wt. % and about 1.5 wt. %. And in some variations, Mo in the cast iron alloy is between about 0.6 wt. % and about 1.0 wt. %, and Ni in the cast iron alloy is between about 0.8 wt. % and about 1.5 wt. %.

The amount of Mg affects the shape of graphite in the cast iron. Particularly, lower levels of Mg result in vermicular or flake graphite in the cast iron alloy and higher levels result in intercellular carbides and shrinkage porosity. Accordingly, a lower limit of Mg in the cast iron alloy is about 0.01 wt. % and an upper limit of Mg in the cast iron alloy is about 0.075 wt. %. And in at least one variation, Mg content in the cast iron alloy is between about 0.02 wt. % and about 0.05 wt. %.

The amount of Al affects high temperature oxidation resistance, carbon activity, and ductility of the cast iron alloy. Particularly, high concentrations of aluminum generally improve the high temperature oxidation resistance but decrease the ductility of the cast iron alloy. Accordingly, a lower limit of Al in the cast iron alloy is about 1.8 wt. % and an upper limit of Al in the cast iron alloy is about 3.5 wt. %. And in at least one variation, Al in the cast iron alloy is between about 2.0 wt. % and about 3.2 wt. %.

Sulfur is typically present as an impurity and has a desired content of less than about 0.03 wt. % In some variations, S is present in the cast iron alloy between about 0.003 wt. % and about 0.025 wt. %. And in at least one variation, S is present in the cast iron alloy between about 0.005 wt. % and about 0.015 wt. %.

Zirconium, Ce, and La affect the nucleation of graphite in the cast iron alloy by assisting in and/or forming heterogeneous nucleation sites for graphite nodules. In some variations, Zr is present in the cast iron alloy between about 0.001 wt. % and about 0.02 wt. %. In at least one variation, Ce is present in the cast iron alloy between about 0.001 wt. % and about 0.03 wt. %. And in some variations, La is present in the cast iron alloy between about 0.0005 wt. % and about 0.02 wt. %.

Table 1 provides a range of the alloying elements (in wt. %) in the cast iron alloy.

TABLE 1

| Alloying Element | Broad Range | Narrow Range |
|---|---|---|
| C | 2.6-3.4 | 2.8-3.2 |
| Si | 2.4-3.2 | 2.6-3.2 |
| Mn | 0.3-0.6 | 0.32-0.5 |
| Mo | 0.4-1.2 | 0.6-1.0 |
| Ni | 0.6-1.75 | 0.8-1.5 |
| Mg | 0.01-0.075 | 0.02-0.05 |
| Al | 1.8-3.5 | 2.0-3.2 |
| S | 0.003-0.025 | 0.005-0.015 |
| Zr | 0.001-0.02 | 0.001-0.01 |
| Ce | 0.001-0.03 | 0.002-0.02 |
| La | 0.0005-0.02 | 0.001-0.02 |
| Fe | Bal. | Bal. |

Experimental

A series of cast iron compositions (wt. %) where evaluated with a few examples provided below in Table 2.

TABLE 2

| Alloying | Alloy | | |
|---|---|---|---|
| Element | SiMo51 | SiMo1.8Al | SiMo3Al |
| C | 3.2 | 3.0 | 3.0 |
| Si | 4.2 | 3.0 | 2.9 |
| Mn | 0.3 | 0.2 | 0.3 |
| Mo | 0.7 | 0..8 | 0.8 |
| Ni | 0.2 | 0.9 | 0.9 |
| Mg | 0.03 | 0.05 | 0.05 |
| Al | — | 1.8 | 3.0 |
| S | 0.005 | 0.008 | 0.008 |
| Zr | — | 0.01 | 0.01 |
| Ce | — | 0.005 | 0.005 |
| La | — | 0.005 | 0.005 |
| Fe | Bal. | Bal. | Bal. |

Figure 1A:
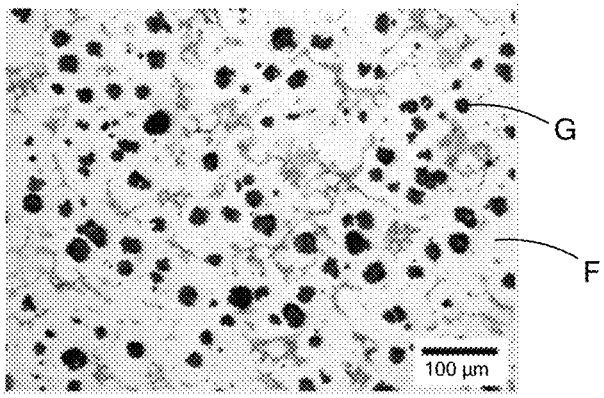
FIG. 1A is an optical micrograph of a commercial SiMo51 cast iron alloy.
Figure 1B:
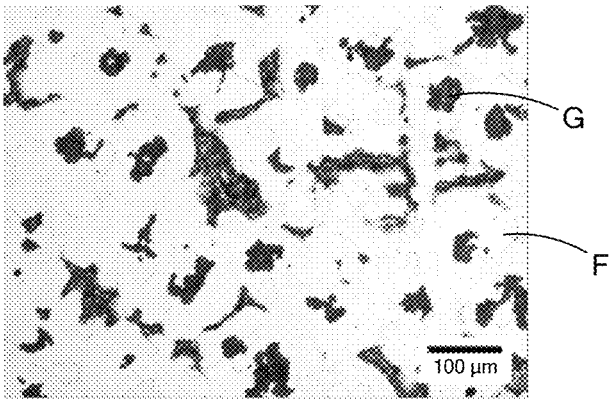
FIG. 1B is an optical micrograph of a cast iron alloy with 1.8 wt. % aluminum according to the teachings of the present disclosure.
Figure 1C:
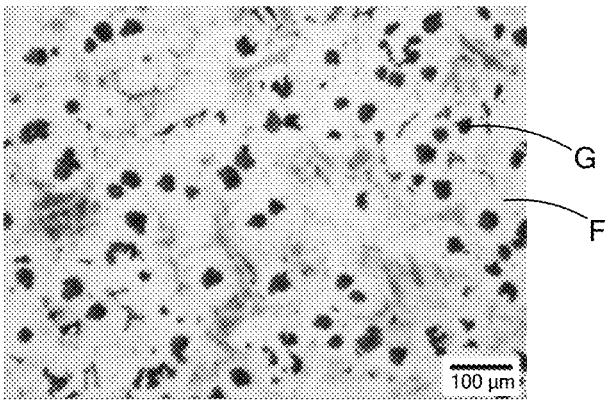
FIG. 1C is an optical micrograph of a cast iron alloy with 3.0 wt. % aluminum according to the teachings of the present disclosure.
Figure 2A:
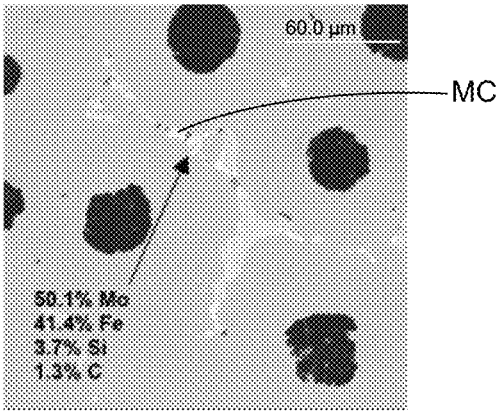
FIG. 2A is a scanning electron microscopy (SEM) image of the microstructure of the commercial SiMo51 cast iron alloy and an energy dispersive x-ray (EDX) analysis (wt. %) of an interdendritic molybdenum carbide.
Figure 2B:
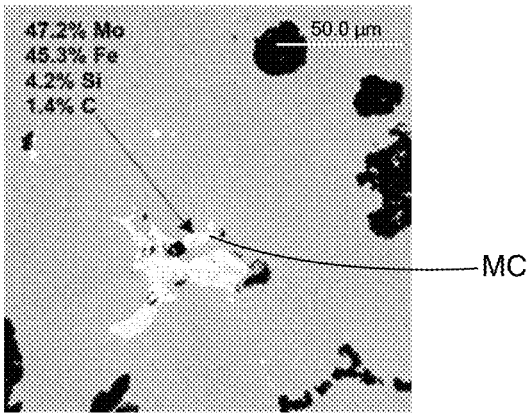
FIG. 2B is an SEM image of the mcirstructure of the cast iron alloy with 3.0 wt. % aluminum and an EDX analysis (wt. %) of an interdendritic molybdenum carbide.
Figure 2C:
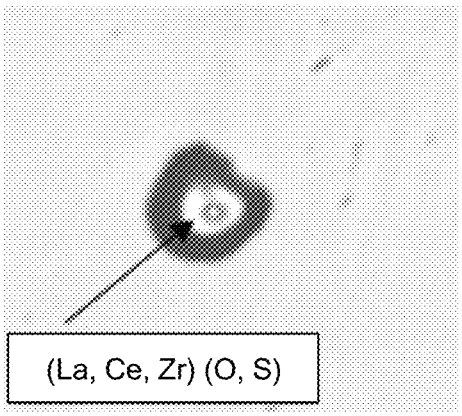
FIG. 2C is an SEM image of a graphite nuclei in the form of a lanthanum, cerium, zirconium precipitate in the cast iron alloy with 3.0 wt. % aluminum.

Referring to FIGS. 1A-1C, as-cast microstructures of the commercial SiMo51 alloy (FIG. 1A—used as a base alloy or base composition), the SiMo1.8Al alloy (FIG. 1B), and the SiMo3Al alloy (FIG. 1C) are shown. Each of the three alloys had a predominantly ferritic matrix 'F' with Si and Al in solid solution, graphite nodules 'G', and molybdenum carbides 'MC' at eutectic grain boundaries as shown in FIGS. 2A-2B. The SiMo51 alloy exhibited mostly spherical graphite nodules with some distortions due to the relatively high Si content. The graphite nodules in the SiMo1.8Al and SiMo3Al were less spherical. However, microalloying (i.e., alloy additions less than 0.1 wt. %) of the SiMo1.8Al and SiMo3Al alloys with Ce, La, and Zr reduced distortion of the graphite nodule shape compared to cast iron alloys with relatively high Al concentrations and no microalloying with Ce, La, and/or Zr. While not being bound by theory, it is believed the microalloying of the SiMo1.8Al and SiMo3Al alloys with the Ce, La, and Zr provided La, Ce, Zr—rich nucleation sites (e.g., see FIG. 2C) for precipitation of graphite nodules, which in turn assisted in the reduced distortion of the graphite nodule shape in these alloys.

Figure 3:
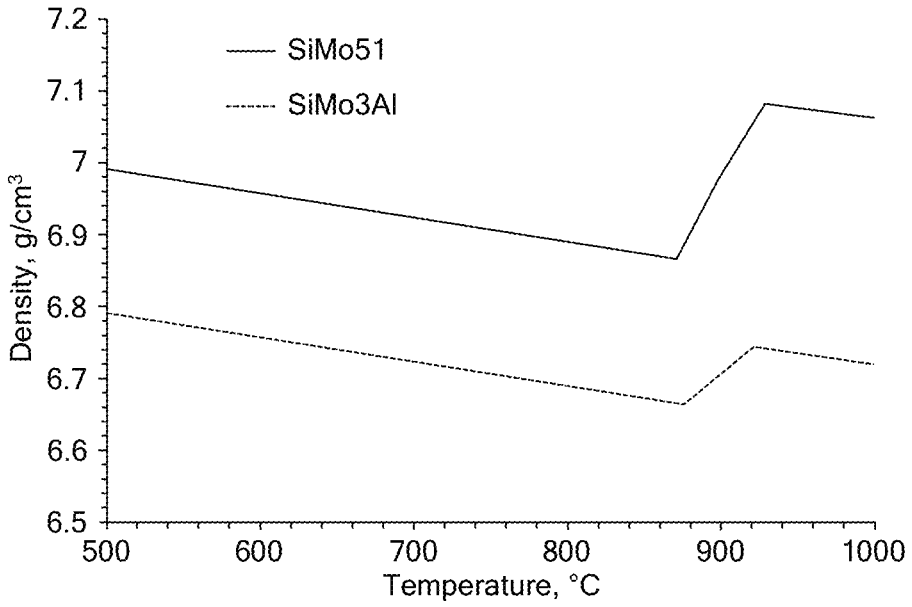
FIG. 3 is a plot of ThermoCalc calculated change in density as a function of temperature for the commercial SiMo51 cast iron alloy and the cast iron alloy with 3.0 wt. % aluminum.

One factor that can be considered with respect to TMF resistance of a cast iron alloy is a change in density of the alloy as a function of temperature. Particularly, relatively large changes in density with increasing and decreasing temperature can result in significant internal stresses within a cast iron component and such internal stresses can enhance fatigue cracking. Accordingly, ThermoCalc simulations of the change in density as a function of temperature were conducted on the SiMo51 alloy and the SiMo3Al alloy and the results are shown in FIG. 3. Particularly, FIG. 3 shows ThermoCalc calculated changes in density for transformation of the ferritic matrix in the SiMo51 and SiMo3Al alloys to austenite (i.e., the eutectoid reaction/transformation) at temperatures between about 860° C. and about 940° C. It should be understood that the term "ThermoCalc" refers to the software, databases, add-on modules, and software development kits (SDKs) available from Thermo-Calc Software. The change in density for the SiMo51 alloy is about 0.22 grams per cubic centimeter (g/cm$^3$), while the change in density for the SiMo3Al alloy is about 0.08 g/cm$^3$. Accordingly, the SiMo3Al alloy exhibits a change in density about one-third (36%) of the change in density of the SiMo51 alloy between about 860° C. and about 940° C. Accordingly, the Al in the SiMo3Al alloy not only reduces the density of the ferrite in the alloy (i.e., between 500-860° C.), but to a greater extent the Al reduces the density of the austenite in the SiMo3Al alloy.

Figure 4A:
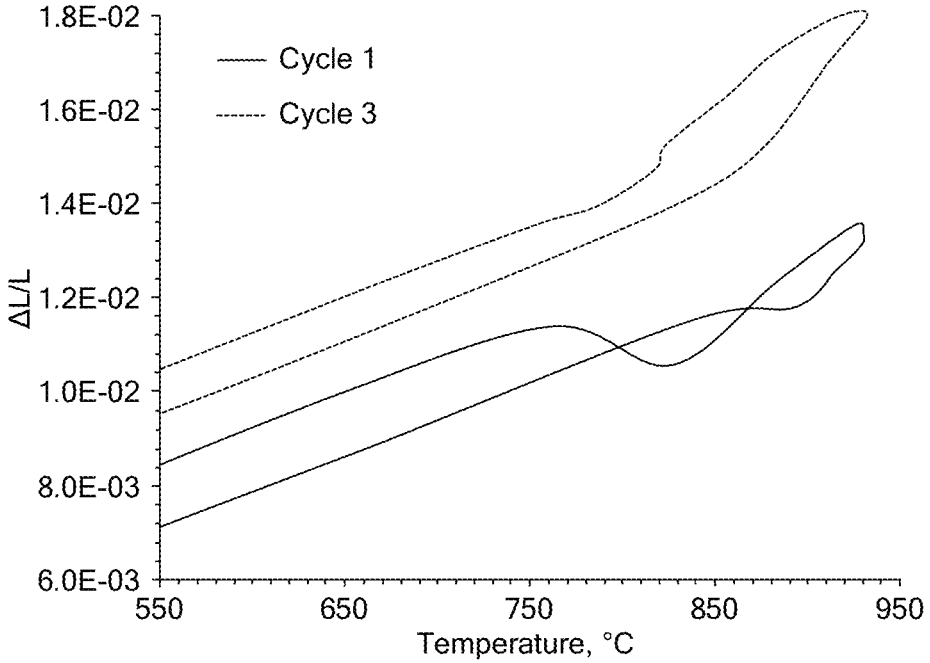
FIG. 4A is a plot of experimentally measured change in linear dimension as a function of temperature during three thermal cycles for the commercial SiMo51 cast iron alloy.
Figure 4B:
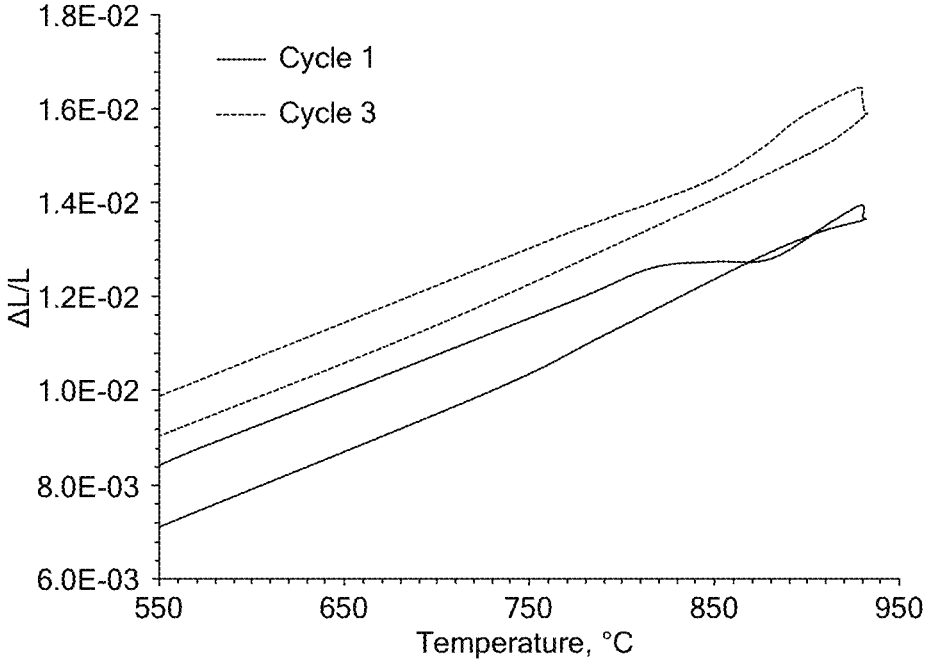
FIG. 4B is a plot of experimentally measured change in linear dimension as a function of temperature during three thermal cycles for the cast iron alloy with 1.8 wt. % aluminum.
Figure 4C:
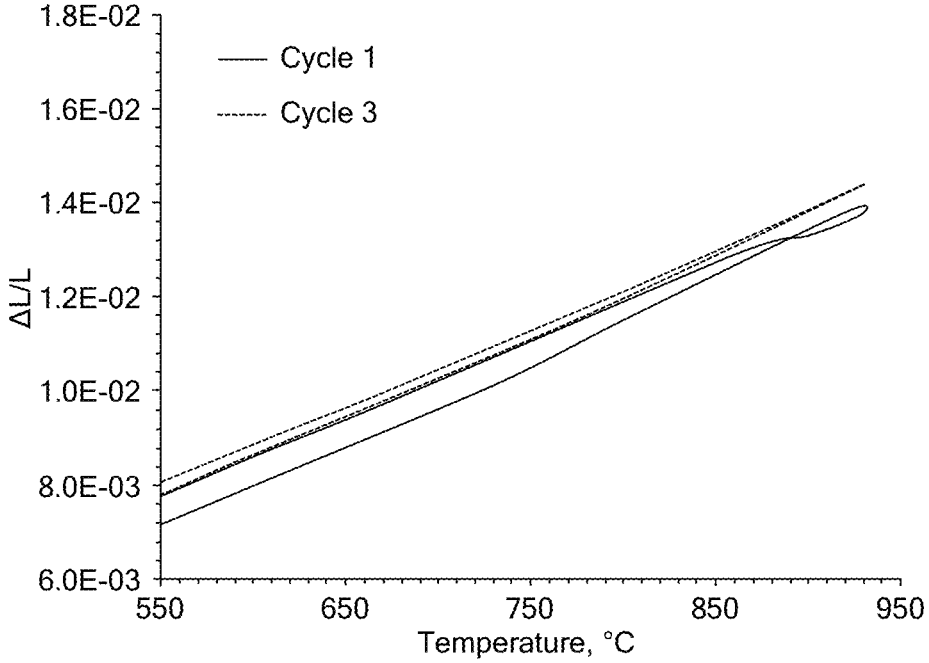
FIG. 4C is a plot of experimentally measured change in linear dimension as a function of temperature during three thermal cycles for the cast iron alloy with 3.0 wt. % aluminum.

In addition to change in density of a cast iron alloy, dimensional stability during thermal cycling can play an important role in the lifetime of a cast iron component. Accordingly, linear expansion testing as a function of increasing temperature and linear contraction as a function of decreasing temperature for the SiMo51 alloy, the SiMo1.8Al alloy, and the SiMo3Al alloy, were conducted and the results are shown in FIGS. 4A-4C. The linear expansion and linear contraction measurements were conducted on SiMo51, Si1.8Al, and SiMo3Al cast iron alloy specimens in an argon (Ar) atmosphere via dilatometry. In addition, the measurements were taken for the SiMo51, Si1.8Al, and SiMo3Al cast iron alloy specimens subjected to the following three cycle routine:

cycle 1=>heating from 20° C. to 930° C. at 5° C. per minute (° C./min)—holding at 930° C. for 20 minutes—cooling from 930° C. to 500° C. at −5° C./min—holding at 500° C. for 20 minutes;

cycle 2=>heating from 500° C. to 930° C. at 5° C./min—holding at 930° C. for 20 minutes—cooling from 930° C. to 500° C. at −5° C./min—holding at 500° C. for 20 minutes; and cycle 3=>heating from 500° C. to 930° C. at 5° C./min—holding at 930° C. for 20 minutes—cooling from 930° C. to 500° C. at −5° C./min—holding at 500° C. for 20 minutes (i.e., cycle 3=cycle 2).

FIGS. 4A-4C show the linear changes for cycles 1 and 3, and as shown by comparing FIG. 4A to FIG. 4C, the SiMo51 alloy exhibited a linear change of about 0.25% between 500° C. and 930° C., while the SiMo3Al alloy exhibited a linear change of about 0.03% between 500° C. and 930° C. (i.e., a reduction by a factor of about ten). Also, the additions of Al decreased hysteresis of the cooling-heating cycles and increased the Act Ac3, Ar3, and Ar3 temperatures (also known as "critical temperatures") compared to the SiMo51 alloy as shown in Table 3 below (cooling rate=5° C./min; cooling rate=−5° C./min).

TABLE 3

| | Critical Temperature | | | |
|---|---|---|---|---|
| Alloy | Ac1 | Ac3 | Ar3 | Ar1 |
| SiMo51 | 855 | 890 | 825 | 765 |
| SiMo1.8Al | 900 | 910 | 880 | 830 |
| SiMo3Al | 895 | 945 | 900 | 880 |

It should be understood that the "Ac1 temperature" is the temperature at which ferrite starts to transform to austenite upon heating at a specified heating rate, the Ac3 temperature is the temperature at which ferrite is completely transformed to austenite upon heating at a specified heating rate, the Ar3 temperature is the temperature at which austenite begins to transform to ferrite upon cooling at a specified cooling rate, and the Ar1 temperature is the temperature which austenite completely transforms to ferrite at a specified cooling rate.

Figure 5A:
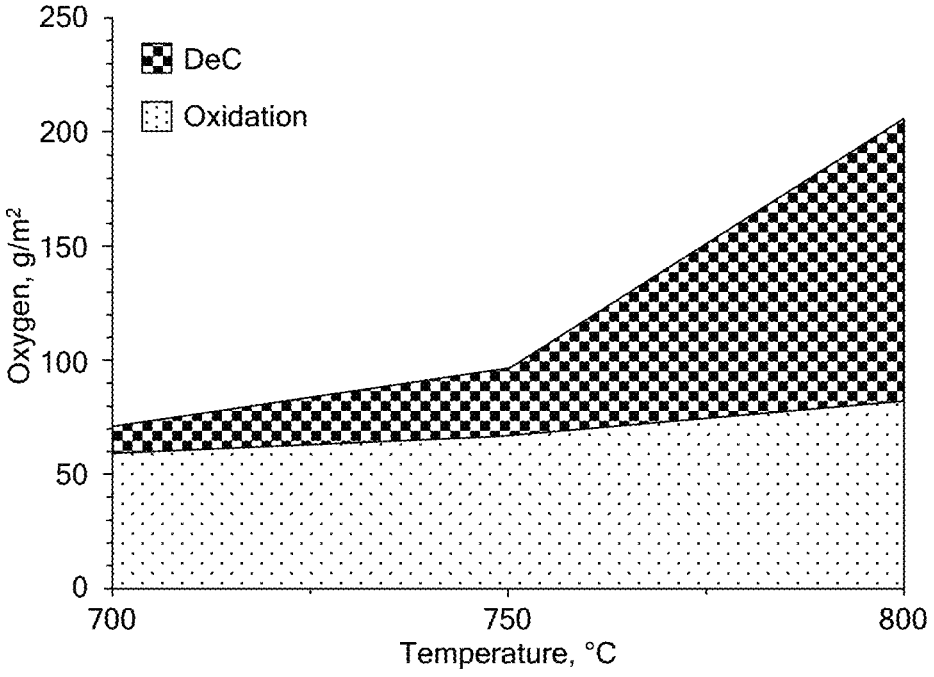
FIG. 5A is a plot of amount of oxygen reacted during oxidation and decarburization of the commercial SiMo51 cast iron alloy as a function temperature during oxidation in air for 100 hours.
Figure 5B:
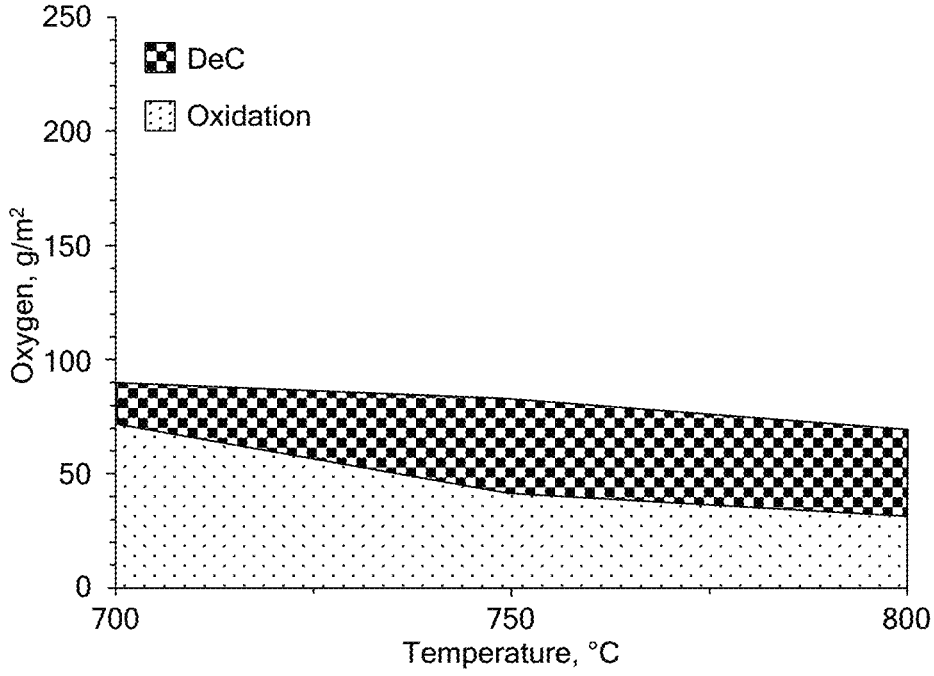
FIG. 5B is a amount of oxygen reacted during oxidation and decarburization of the cast iron alloy with 1.8 wt. % aluminum as a function temperature during oxidation in air for 100 hours.
Figure 5C:
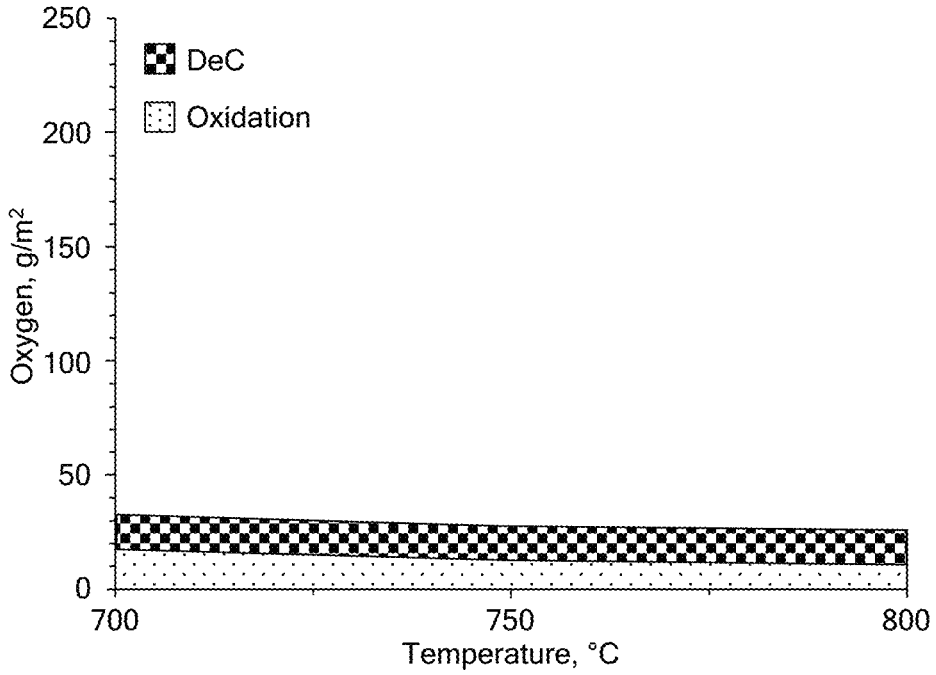
FIG. 5C is a amount of oxygen reacted during oxidation and decarburization of the cast iron alloy with 3.0 wt. % aluminum as a function temperature during oxidation in air for 100 hours.

High temperature oxidation resistance can also be an important factor in the lifetime of a cast iron component. Accordingly, high temperature oxidation testing in air was conducted on the SiMo51, SiMo1.8Al, and SiMo3Al alloys in the as-cast condition, and the results are shown in FIG. 5. Particularly, samples of the SiMo51, SiMo1.8Al, and SiMo3Al alloys in the as-cast condition were placed and exposed for 100 hours to air in a furnace at 700° C., 750° C., and 800° C. The applied test method included controlling weight change and carbon analysis to decouple two major oxidation processes, i.e., oxidation of metallic components to form an oxide scale on the cast iron alloy and decarburization (de-C) of the cast iron alloy. For the commercial SiMo51 alloy, increasing the test temperature above 750° C. significantly increased decarburization, while the amount of oxide scale formation steadily increased (FIG. 5A). For the SiMo3Al alloy, the total amount of reacted oxygen for oxide scale formation and decarburization was significantly reduced compared to the commercial SiMo51 alloy and temperature had a minimal effect on the amount of oxide scale formed (FIG. 5C). For the SiMo1.8Al alloy, intermediate behavior between the SiMo51 and SiMo3Al alloys was observed (FIG. 5C).

Elevated temperature strength can also be an important factor when selecting and using a cast iron alloy at high temperatures. Accordingly, high temperature mechanical testing of the SiMo51, SiMo1.8Al, and SiMo3Al alloys was conducted and the results are shown in FIG. 6. Particularly, tensile testing of the SiMo51, SiMo1.8Al, and SiMo3Al alloys at 600, 700, 750, and 800° C. was performed and a plot of ultimate tensile strength (also referred to herein simply as "tensile strength") as a function of these temperatures is shown in FIG. 6. And as shown in FIG. 6, the SiMo3Al alloy, compared to the SiMo51 alloy, exhibited an approximate 50% increase in tensile strength at 600° C., an approximate 68% increase in tensile strength at 700° C., an approximate 36% increase in tensile strength at 750° C., and an approximate 52% increase in tensile strength at 800° C.

Accordingly, it should be understood that the SiMo3Al alloy exhibits a combination of improved dimensional stability, high temperature oxidation resistance and high temperature strength compared to the SiMo51 alloy. In addition, TMF testing of the SiMo3Al confirmed its enhanced performance at elevated temperatures. Particularly, TMF testing of the SiMo51, SiMo0.5Cr, SiMo1Cr, and SiMo3Al alloys was conducted and the results are shown in FIG. 7. The TMF testing consisted of cycles of: 2 minute heat cycle from 400 to 800° C.—2 minute cooling cycle from 800 to 400° C., in combination with imposed strain on the samples. The mechanical strain 'ΔE' imposed on a specimen during a given test is shown on the vertical axis and the total number of cycles to failure 'Nf' (i.e., when a crack occurs in the specimen) is shown on the horizontal axis (logarithmic base 10 scale). In addition, the imposed strain was "out of phase" in that a tensile strain was applied at 400° C. and a compressive strain was applied at 800° C., and out of phase TMF testing simulates conditions of automotive components (e.g., an exhaust manifold) during normal start up/shut down engine operation. And as shown in FIG. 7, the number of cycles to failure Nf for the SiMo1.8Al and SiMo3Al alloys is approximately 20× greater than the number of cycles to failure Nf for the SiMo51 alloy. Stated differently, the SiMo1.8Al and SiMo3Al alloys exhibited a 20-fold increase in TMF resistance compared to the commercial SiMo51 alloy.

Accordingly, the present disclosure provides a cast iron alloy with enhanced physical, mechanical, and high temperature oxidation properties that can be used for a range of applications. For example, in some variations the cast iron alloy according to the teachings of the present disclosure is used in automotive application such as for exhaust manifolds and turbo housings, among others.

In some variations, the cast iron alloy has a chemical composition of C between 2.6 to 3.4 wt. %, Si between 2.4 to 3.2 wt. %, Mn between 0.3 to 0.6 wt. %, Mn between 0.4 to 1.2 wt. %, Ni between 0.6 to 1.75 wt. %, Mg between 0.01 to 0.075 wt. %, Al between 1.8 to 3.5 wt. %, S between 0.003 to 0.025 wt. %, Zr between 0.001 to 0.02 wt. %, Ce between 0.001 to 0.03 wt. %, La between 0.0005 to 0.02 wt. %, and a balance or Fe and unavoidable trace elements. In addition, in at least two variations the cast iron alloy with this composition has a thermo-mechanical fatigue lifetime of at least 10,000 cycles when cycled between 400° C. to 800° C. with a total cyclic strain equal to 0.001 m/m. And in some variations, the cast iron alloy with this composition has a thermo-mechanical fatigue lifetime of at least 2,000 cycles when cycled between 400° C. to 800° C. with a total cyclic strain equal to 0.002 m/m.

In some variations, the cast iron alloy has a chemical composition of C between 2.8 to 3.2 wt. %, Si between 2.6 to 3.2 wt. %, Mn between 0.3 to 0.6 wt. %, Mn between 0.4 to 1.2 wt. %, Ni between 0.6 to 1.75 wt. %, Mg between 0.01 to 0.075 wt. %, Al between 1.8 to 3.5 wt. %, S between 0.003 to 0.025 wt. %, Zr between 0.001 to 0.02 wt. %, Ce between 0.001 to 0.03 wt. %, La between 0.0005 to 0.02 wt. %, and a balance or Fe and unavoidable trace elements. In addition, in at least two variations the cast iron alloy with this composition has a thermo-mechanical fatigue lifetime of at least 10,000 cycles when cycled between 400° C. to 800° C. with a total cyclic strain equal to 0.001 m/m. And in some variations, the cast iron alloy with this composition has a thermo-mechanical fatigue lifetime of at least 2,000 cycles when cycled between 400° C. to 800° C. with a total cyclic strain equal to 0.002 m/m.

In at least one variation, the cast iron alloy has a chemical composition of C between 2.6 to 3.4 wt. %, Si between 2.4 to 3.2 wt. %, Mn between 0.32 to 0.5 wt. %, Mn between 0.4 to 1.2 wt. %, Ni between 0.6 to 1.75 wt. %, Mg between 0.01 to 0.075 wt. %, Al between 1.8 to 3.5 wt. %, S between 0.003 to 0.025 wt. %, Zr between 0.001 to 0.02 wt. %, Ce between 0.001 to 0.03 wt. %, La between 0.0005 to 0.02 wt. %, and a balance or Fe and unavoidable trace elements. In addition, in at least two variations the cast iron alloy with this composition has a thermo-mechanical fatigue lifetime of at least 10,000 cycles when cycled between 400° C. to 800° C. with a total cyclic strain equal to 0.001 m/m. And in some variations, the cast iron alloy with this composition has a thermo-mechanical fatigue lifetime of at least 2,000 cycles when cycled between 400° C. to 800° C. with a total cyclic strain equal to 0.002 m/m.

In some variations, the cast iron alloy has a chemical composition of C between 2.6 to 3.4 wt. %, Si between 2.4 to 3.2 wt. %, Mn between 0.3 to 0.6 wt. %, Mn between 0.6 to 1.0 wt. %, Ni between 0.8 to 1.5 wt. %, Mg between 0.01 to 0.075 wt. %, Al between 1.8 to 3.5 wt. %, S between 0.003 to 0.025 wt. %, Zr between 0.001 to 0.02 wt. %, Ce between 0.001 to 0.03 wt. %, La between 0.0005 to 0.02 wt. %, and a balance or Fe and unavoidable trace elements. In addition, in at least two variations the cast iron alloy with this composition has a thermo-mechanical fatigue lifetime of at least 10,000 cycles when cycled between 400° C. to 800° C. with a total cyclic strain equal to 0.001 m/m. And in some variations, the cast iron alloy with this composition has a thermo-mechanical fatigue lifetime of at least 2,000 cycles when cycled between 400° C. to 800° C. with a tota cyclic strain equal to 0.002 m/m.

In at least one variation, the cast iron alloy has a chemical composition of C between 2.6 to 3.4 wt. %, Si between 2.4 to 3.2 wt. %, Mn between 0.3 to 0.6 wt. %, Mn between 0.4 to 1.2 wt. %, Ni between 0.6 to 1.75 wt. %, Mg between 0.02 to 0.05 wt. %, Al between 1.8 to 3.5 wt. %, S between 0.003 to 0.025 wt. %, Zr between 0.001 to 0.02 wt. %, Ce between 0.001 to 0.03 wt. %, La between 0.0005 to 0.02 wt. %, and a balance or Fe and unavoidable trace elements. In addition, in at least two variations the cast iron alloy with this composition has a thermo-mechanical fatigue lifetime of at least 10,000 cycles when cycled between 400° C. to 800° C. with a total cyclic strain equal to 0.001 m/m. And in some variations, the cast iron alloy with this composition has a thermo-mechanical fatigue lifetime of at least 2,000 cycles when cycled between 400° C. to 800° C. with a total cyclic strain equal to 0.002 m/m.

In some variations, the cast iron alloy has a chemical composition of C between 2.6 to 3.4 wt. %, Si between 2.4 to 3.2 wt. %, Mn between 0.3 to 0.6 wt. %, Mn between 0.4 to 1.2 wt. %, Ni between 0.6 to 1.75 wt. %, Mg between 0.01 to 0.075 wt. %, Al between 2.0 to 3.2 wt. %, S between 0.003 to 0.025 wt. %, Zr between 0.001 to 0.02 wt. %, Ce between 0.001 to 0.03 wt. %, La between 0.0005 to 0.02 wt. %, and a balance or Fe and unavoidable trace elements. In addition, in at least two variations the cast iron alloy with this composition has a thermo-mechanical fatigue lifetime of at least 10,000 cycles when cycled between 400° C. to 800° C. with a total cyclic strain equal to 0.001 m/m. And in some variations, the cast iron alloy with this composition has a thermo-mechanical fatigue lifetime of at least 2,000 cycles when cycled between 400° C. to 800° C. with a total cyclic strain equal to 0.002 m/m.

In at least one variation, the cast iron alloy has a chemical composition of C between 2.6 to 3.4 wt. %, Si between 2.4 to 3.2 wt. %, Mn between 0.3 to 0.6 wt. %, Mn between 0.4 to 1.2 wt. %, Ni between 0.6 to 1.75 wt. %, Mg between 0.01 to 0.075 wt. %, Al between 1.8 to 3.5 wt. %, S between 0.005 to 0.015 wt. %, Zr between 0.002 to 0.02 wt. %, Ce between 0.001 to 0.03 wt. %, La between 0.0005 to 0.02 wt. %, and a balance or Fe and unavoidable trace elements. In addition, in at least two variations the cast iron alloy with this composition has a thermo-mechanical fatigue lifetime of at least 10,000 cycles when cycled between 400° C. to 800° C. with a total cyclic strain equal to 0.001 m/m. And in some variations, the cast iron alloy with this composition has a thermo-mechanical fatigue lifetime of at least 2,000 cycles when cycled between 400° C. to 800° C. with a total cyclic strain equal to 0.002 m/m.

In some variations, the cast iron alloy has a chemical composition of C between 2.6 to 3.4 wt. %, Si between 2.4 to 3.2 wt. %, Mn between 0.3 to 0.6 wt. %, Mn between 0.4 to 1.2 wt. %, Ni between 0.6 to 1.75 wt. %, Mg between 0.01 to 0.075 wt. %, Al between 1.8 to 3.5 wt. %, S between 0.003 to 0.025 wt. %, Zr between 0.001 to 0.02 wt. %, Ce between 0.001 to 0.03 wt. %, La between 0.001 to 0.02 wt. %, and a balance or Fe and unavoidable trace elements. In addition, in at least two variations the cast iron alloy with this composition has a thermo-mechanical fatigue lifetime of at least 10,000 cycles when cycled between 400° C. to 800° C. with a total cyclic strain equal to 0.001 m/m. And in some variations, the cast iron alloy with this composition has a thermo-mechanical fatigue lifetime of at least 2,000 cycles when cycled between 400° C. to 800° C. with a total cyclic strain equal to 0.002 m/m.

In at least one variation, the cast iron alloy has a chemical composition of C between 2.8 to 3.2 wt. %, Si between 2.6 to 3.2 wt. %, Mn between 0.32 to 0.5 wt. %, Mn between 0.6 to 1.0 wt. %, Ni between 0.8 to 1.5 wt. %, Mg between 0.02 to 0.05 wt. %, Al between 2.0 to 3.2 wt. %, S between 0.005 to 0.015 wt. %, Zr between 0.001 to 0.02 wt. %, Ce between 0.002 to 0.02 wt. %, La between 0.001 to 0.02 wt. %, and a balance or Fe and unavoidable trace elements. In addition, in at least two variations the cast iron alloy with this composition has a thermo-mechanical fatigue lifetime of at least 10,000 cycles when cycled between 400° C. to 800° C. with a total cyclic strain equal to 0.001 m/m. And in some variations, the cast iron alloy with this composition has a thermo-mechanical fatigue lifetime of at least 2,000 cycles when cycled between 400° C. to 800° C. with a total cyclic strain equal to 0.002 m/m.

And in some variations, the cast iron alloy has a chemical composition of C between 2.8 to 3.2 wt. %, Si between 2.6 to 3.0 wt. %, Mn between 0.35 to 0.5 wt. %, Mn between 0.6 to 1.0 wt. %, Ni between 0.8 to 1.5 wt. %, Mg between 0.02 to 0.05 wt. %, Al between 2.0 to 3.2 wt. %, S between 0.005 to 0.015 wt. %, Zr between 0.002 to 0.01 wt. %, Ce between 0.002 to 0.02 wt. %, La between 0.001 to 0.01 wt. %, and a balance or Fe and unavoidable trace elements. In addition, in at least two variations the cast iron alloy with this composition has a thermo-mechanical fatigue lifetime of at least 10,000 cycles when cycled between 400° C. to 800° C. with a total cyclic strain equal to 0.001 m/m. And in some variations, the cast iron alloy with this composition has a thermo-mechanical fatigue lifetime of at least 2,000 cycles when cycled between 400° C. to 800° C. with a total cyclic strain equal to 0.002 m/m.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A cast iron alloy with a composition in weight percent (wt. %) comprising:
carbon between 2.6 to 3.4 wt. %;
silicon between 2.4 to 3.2 wt. %;
manganese between 0.3 to 0.6 wt. %;
molybdenum between 0.4 to 1.2 wt. %;
nickel between 0.6 to 1.75 wt. %;
magnesium between 0.01 to 0.075 wt. %;
aluminum between 1.8 to 3.5 wt. %;
sulfur between 0.003 to 0.025 wt. %;
microalloyinq elements consisting of:
zirconium between 0.001 to 0.02 wt. %;
cerium between 0.001 to 0.03 wt. %; and
lanthanum between 0.0005 to 0.02 wt. %; and
a balance of iron and unavoidable trace elements.

2. The cast iron alloy according to claim 1, wherein at least one of carbon is between 2.8 to 3.2 wt. % and silicon is between 2.6 to 3.2 wt. %.

3. The cast iron alloy according to claim 1, wherein manganese is between 0.32 to 0.5 wt. %.

4. The cast iron alloy according to claim 1, wherein at least one of molybdenum is between 0.6 to 1.0 wt. % and nickel is between 0.8 to 1.5 wt. %.

5. The cast iron alloy according to claim 1, wherein magnesium is between 0.02 to 0.05 wt. %.

6. The cast iron alloy according to claim 1, wherein aluminum is between 2.0 to 3.2 wt. %.

7. The cast iron alloy according to claim 1, wherein at least one of sulfur is between 0.005 to 0.015 wt. % and cerium is between 0.002 to 0.02 wt. %.

8. The cast iron alloy according to claim 1, wherein lanthanum is between 0.001 to 0.02 wt. %.

9. The cast iron alloy according to claim 1 further comprising a plurality of graphite nodules formed on a lanthanum containing nuclei.

10. The cast iron alloy according to claim 9, wherein the lanthanum containing nuclei are (La, Ce, Zr)(O, S) nuclei.

11. A part formed from the cast iron alloy according to claim 1, wherein the part comprises an Ac1 temperature equal to or greater than 875° C.

12. The part according to claim 11, wherein the Ac1 temperature is equal to or greater than 885° C.

13. A part formed from the cast iron alloy according to claim 1, wherein the part comprises a thermo-mechanical fatigue lifetime of at least 10,000 cycles when cycled between 400° C. to 800° C. with a total cyclic strain equal to 0.001 m/m.

14. A part formed from the cast iron alloy according to claim 1, wherein the part comprises a thermo-mechanical fatigue lifetime of at least 2,000 cycles when cycled between 400° C. to 800° C. with a total cyclic strain equal to 0.002 m/m.

15. The cast iron alloy according to claim 1, wherein:
carbon is between 2.8 to 3.2 wt. %;
silicon is between 2.6 to 3.0 wt. %;
manganese is between 0.35 to 0.5 wt. %;
molybdenum is between 0.6 to 1.0 wt. %;
nickel is between 0.8 to 1.5 wt. %;
magnesium is between 0.02 to 0.05 wt. %;
aluminum is between 2.0 to 3.2 wt. %;
sulfur is between 0.005 to 0.015 wt. %;
zirconium is between 0.002 to 0.01 wt. %;
cerium is between 0.002 to 0.02 wt. %; and
lanthanum is between 0.001 to 0.01 wt. %.

16. A cast iron alloy with a composition in weight percent (wt. %) comprising:
carbon between 2.6 to 3.4 wt. %;
silicon between 2.4 to 3.2 wt. %;
manganese between 0.32 to 0.6 wt. %;
molybdenum between 0.4 to 1.2 wt. %;
nickel between 0.6 to 1.75 wt. %;
magnesium between 0.01 to 0.075 wt. %;
aluminum between 1.8 to 3.5 wt. %;
sulfur between 0.003 to 0.025 wt. %;

microalloyinq elements consisting of:
zirconium between 0.001 to 0.02 wt. %;
cerium between 0.001 to 0.03 wt. %; and
lanthanum between 0.0005 to 0.02 wt. %; and
a balance of iron and unavoidable trace elements.

17. The cast iron alloy according to claim 16, wherein:
carbon is between 2.8 to 3.2 wt. %;
silicon is between 2.6 to 3.0 wt. %;
manganese is between 0.35 to 0.5 wt. %;
molybdenum is between 0.6 to 1.0 wt. %;
nickel is between 0.8 to 1.5 wt. %;
magnesium is between 0.02 to 0.05 wt. %;
aluminum is between 2.0 to 3.2 wt. %;
sulfur is between 0.005 to 0.015 wt. %;
zirconium is between 0.002 to 0.01 wt. %;
cerium is between 0.002 to 0.02 wt. %; and
lanthanum is between 0.001 to 0.01 wt. %.

18. A part formed from the cast iron alloy according to claim 17, part formed from the cast iron alloy, wherein the part comprises at least one of an Ac1 temperature equal to or greater than 885° C., a thermo-mechanical fatigue lifetime of at least 10,000 cycles when cycled between 400° C. to 800° C. and a total cyclic strain equal to 0.001 m/m, and a thermo-mechanical fatigue lifetime of at least 2,000 cycles when cycled between 400° C. to 800° C. with a total cyclic strain equal to 0.002 m/m.

19. A cast iron alloy with a composition in weight percent (wt. %) comprising:
carbon between 2.6 to 3.4 wt. %;
silicon between 2.4 to 3.2 wt. %;
manganese between 0.35 to 0.5 wt. %;
molybdenum between 0.4 to 1.2 wt. %;
nickel between 0.6 to 1.75 wt. %;
magnesium between 0.01 to 0.075 wt. %;
aluminum between 1.8 to 3.5 wt. %;
sulfur between 0.003 to 0.025 wt. %;
microalloyinq elements consisting of:
zirconium between 0.001 to 0.02 wt. %;
cerium between 0.001 to 0.03 wt. %; and
lanthanum between 0.0005 to 0.02 wt. %;
balance of iron and unavoidable trace elements; and
a plurality of graphite nodules formed on (La, Ce, Zr)(O, S) nuclei.

20. A part formed from the cast iron alloy according to claim 19, part formed from the cast iron alloy, wherein the part comprises a thermo-mechanical fatigue lifetime of at least 10,000 cycles when cycled between 400° C. to 800° C. and a total cyclic strain equal to 0.001 m/m, and a thermo-mechanical fatigue lifetime of at least 2,000 cycles when cycled between 400° C. to 800° C. with a total cyclic strain equal to 0.002 m/m.

* * * * *